US007090578B2

(12) United States Patent
Anderson et al.

(10) Patent No.: US 7,090,578 B2
(45) Date of Patent: Aug. 15, 2006

(54) RAFFLE ASSEMBLY

(75) Inventors: Joseph M. Anderson, 2435 Upper Mountain Rd., Sanborn, NY (US) 14132; Oleg M. Sukhotskiy, East Amherst, NY (US)

(73) Assignee: Joseph M. Anderson, Sanborn, NY (US)

( * ) Notice: Subject to any disclaimer, the term of this patent is extended or adjusted under 35 U.S.C. 154(b) by 0 days.

(21) Appl. No.: 10/833,702

(22) Filed: Apr. 28, 2004

(65) Prior Publication Data

US 2004/0254008 A1 Dec. 16, 2004

Related U.S. Application Data

(60) Provisional application No. 60/467,219, filed on May 1, 2003.

(51) Int. Cl.
*A63F 13/00* (2006.01)

(52) U.S. Cl. ..... 463/16; 463/17; 463/36; 273/139; 273/144 A; 273/144 B

(58) Field of Classification Search ..... 463/16–17, 463/36; 273/139, 144 A, 144 B; 206/39; 232/18

See application file for complete search history.

(56) References Cited

U.S. PATENT DOCUMENTS 3,688,276 A * 8/1972 Quinn ..... 358/1.18
4,191,376 A * 3/1980 Goldman et al. ..... 273/139
4,192,618 A * 3/1980 Kondur et al. ..... 400/618
4,573,954 A * 3/1986 Berger et al. ..... 493/55
4,654,793 A 3/1987 Elrod
4,669,730 A * 6/1987 Small ..... 463/17
4,832,341 A * 5/1989 Muller et al. ..... 463/17
4,982,337 A * 1/1991 Burr et al. ..... 700/235
5,129,652 A 7/1992 Wilkinson
5,239,165 A * 8/1993 Novak ..... 235/375
5,408,417 A 4/1995 Wilder
5,419,557 A * 5/1995 Kirkland et al. ..... 273/144 B
5,537,314 A 7/1996 Kanter
5,755,369 A 5/1998 Holmes
5,855,369 A * 1/1999 Lieberman ..... 273/139
6,053,497 A * 4/2000 Such ..... 273/138.1
6,234,477 B1 * 5/2001 Scrymgeour et al. ..... 273/139

(Continued)

FOREIGN PATENT DOCUMENTS

EP 150103 A2 * 7/1985

(Continued)

*Primary Examiner*—John M. Hotaling, II
*Assistant Examiner*—William McCulloch, Jr.
(74) *Attorney, Agent, or Firm*—Phillips Lytle LLP

(57) ABSTRACT

A fully automated raffle assembly (15) comprising a data collection device (16) adapted to read information, a printer (18) communicating with the data collection device and adapted to print a raffle ticket (19), the printer and the data collection device so configured and arranged that the information read by the data collection device is communicated to the printer and printed on the ticket, a collection bin (20), the printer and collection bin so configured and arranged that the ticket is automatically fed into the collection bin after it is printed by the printer. The data collection device may be selected from a group consisting of a bar code scanner and a magnetic code scanner. The raffle assembly may further comprise a ticket guide (21) between the printer and the collection bin, the ticket guide configured to direct the ticket from the printer into the collection bin. The raffle assembly may further comprise a processor (22) with the data collection device and the printer communicating through the processor.

14 Claims, 11 Drawing Sheets

U.S. PATENT DOCUMENTS

| | | | | |
|---|---|---|---|---|
| 6,244,596 | B1 * | 6/2001 | Kondratjuk | 273/143 R |
| 6,513,710 | B1 | 2/2003 | Haas | |
| 2001/0030231 | A1 | 10/2001 | Grossman | |
| 2002/0113986 | A1 * | 8/2002 | MacDonald | 358/1.12 |
| 2002/0143620 | A1 | 10/2002 | Kraus | |
| 2002/0165731 | A1 | 11/2002 | Dempsey | |
| 2003/0014275 | A1 | 1/2003 | Bearden, III et al. | |
| 2003/0087691 | A1 * | 5/2003 | Kiely et al. | 463/25 |
| 2003/0181235 | A1 * | 9/2003 | Bennett | 463/17 |
| 2003/0181236 | A1 * | 9/2003 | Okuniewicz | 463/17 |
| 2003/0186739 | A1 * | 10/2003 | Paulsen et al. | 463/25 |
| 2003/0199296 | A1 * | 10/2003 | Taltavuil et al. | 463/16 |
| 2003/0233168 | A1 * | 12/2003 | Perin et al. | 700/236 |

FOREIGN PATENT DOCUMENTS

| | | | |
|---|---|---|---|
| FR | 2614452 | | 10/1988 |
| GB | 2193441 A | * | 2/1988 |
| GB | 2261097 A | * | 5/1993 |
| WO | WO 87/03116 | | 5/1987 |

* cited by examiner

RAFFLE ASSEMBLY

This application claims the benefit of U.S. Provisional Application(s) No(s) 60/467,219, filed May 1, 2003.

TECHNICAL FIELD

The present invention relates generally to the field of raffle devices and, more particularly, to a fully automated raffle assembly.

BACKGROUND ART

It is known in the prior art that visitors to trade shows can fill out an information card before entering a show hall, and that once in the hall exhibitors at the show can scan or swipe a visitor's card to enter that visitor's information into the exhibitor's lead retrieval system. Exhibitors also sometimes have a label printer that enables them to print a hard copy of such visitor information. It is also known that visitors to certain exhibitor's booths can be provided with an opportunity to enter raffles for various prizes. To enter the raffle, the visitor either provides a business card or manually fills out a raffle slip and the business card or slip is manually deposited in a raffle bin by the visitor or the exhibitor.

However, devices known in the prior art do not provide a fully automated raffle system. Raffle assemblies known in the prior art require that the visitor or potential customer manually fill out a raffle ticket or that the ticket be manually placed in a collection bin. Hence, it would be useful to provide a raffle gathering and deposit system which is fully automated.

DISCLOSURE OF THE INVENTION

With parenthetical reference to the corresponding parts, portions or surfaces of the disclosed embodiment, merely for purposes of illustration and not by way of limitation, the present invention provides a fully automated raffle assembly (15) comprising a data collection device (16) adapted to read information, a printer (18) communicating with the data collection device and adapted to print a raffle ticket (19), the printer and the data collection device so configured and arranged that the information read by the data collection device is communicated to the printer and printed on the ticket, a collection bin (20), the printer and collection bin so configured and arranged that the ticket is automatically fed into the collection bin after it is printed by the printer. The data collection device may be selected from a group consisting of a bar code scanner and a magnetic code scanner. The raffle assembly may further comprise a ticket guide (21) between the printer and the collection bin, the ticket guide configured to direct the ticket from the printer into the collection bin. The ticket guide may comprise a printer discharge port (23) and a collection bin drop slot (24) with the discharge port aligned in the drop slot such that the ticket from the printer is fed from the discharge port through the drop slot, and may further comprise an adjustment mechanism (57) between the printer and the collection bin adapted to move the discharge port relative to the drop slot. The collection bin may comprise an access door (26) and the ticket guide may comprise a ticket chute (28) between the printer and the access door and an ejector guide (29) between the printer and the ticket chute. The raffle assembly may further comprise a processor (22) with the data collection device and the printer communicating through the processor. The processor may be programmed to store information from the data collection device. The raffle assembly may further comprise a digital display (25) communicating with the data collection device and adapted to display information read by the data collection device. The raffle assembly may further comprise a processor with the digital display and a data collection device communicating through the processor. The raffle assembly may further comprise an advertising support member (30). The printer may be supported over the collection bin and the collection bin may be supported over the data collection device.

Accordingly, the general object of the present invention is to provide a fully automated raffle assembly.

Another object is to provide a raffle assembly that does not require the manual entry of information on a raffle ticket nor the manual deposit of the raffle ticket in a raffle collection bin.

Another object is to provide an improved raffle assembly that may be operated without supervision.

Another object is to provide an improved raffle assembly that allows for the participant to view the printing of his or her raffle ticket and the automatic deposit of that ticket in the raffle bin.

Another object is to provide an improved raffle assembly that allows for the participant to view his or her contact information digitally before it is printed on a raffle ticket.

Another object is to provide an improved raffle assembly that allows for information to be electronically scanned.

Another object is to provide an improved raffle assembly with the capability of storing information collected through the incentive of winning a prize.

Another object is to provide an improved raffle assembly that may be used in multiple venues.

These and other objects and advantages will become apparent from the foregoing and ongoing written specification, the drawings, and the appended claims.

DESCRIPTION OF THE PREFERRED EMBODIMENTS

Figure 1:
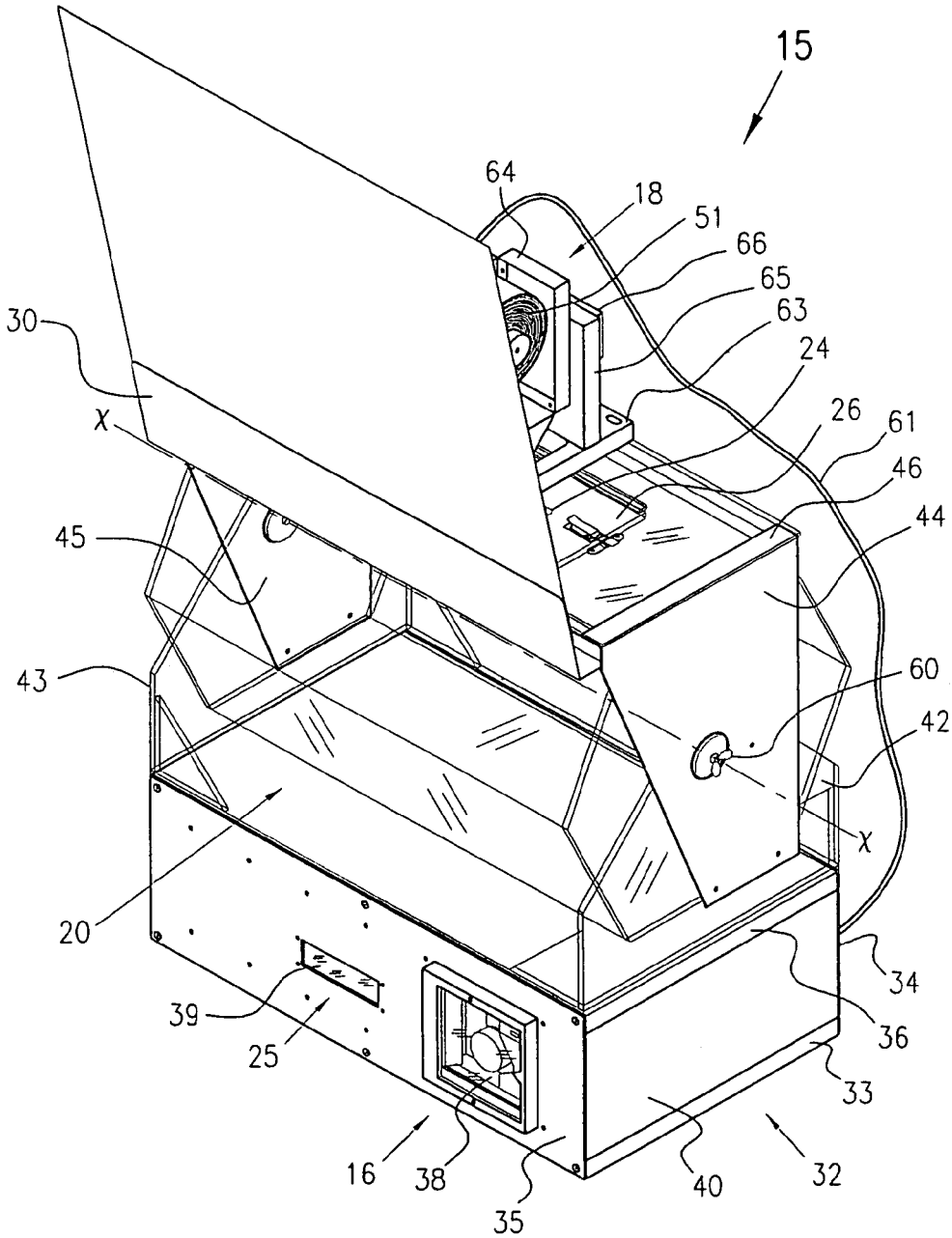
FIG. 1 is perspective view of the improved raffle assembly.

At the outset, it should be clearly understood that like reference numerals are intended to identify the same structural elements, portions or surfaces, consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 2:
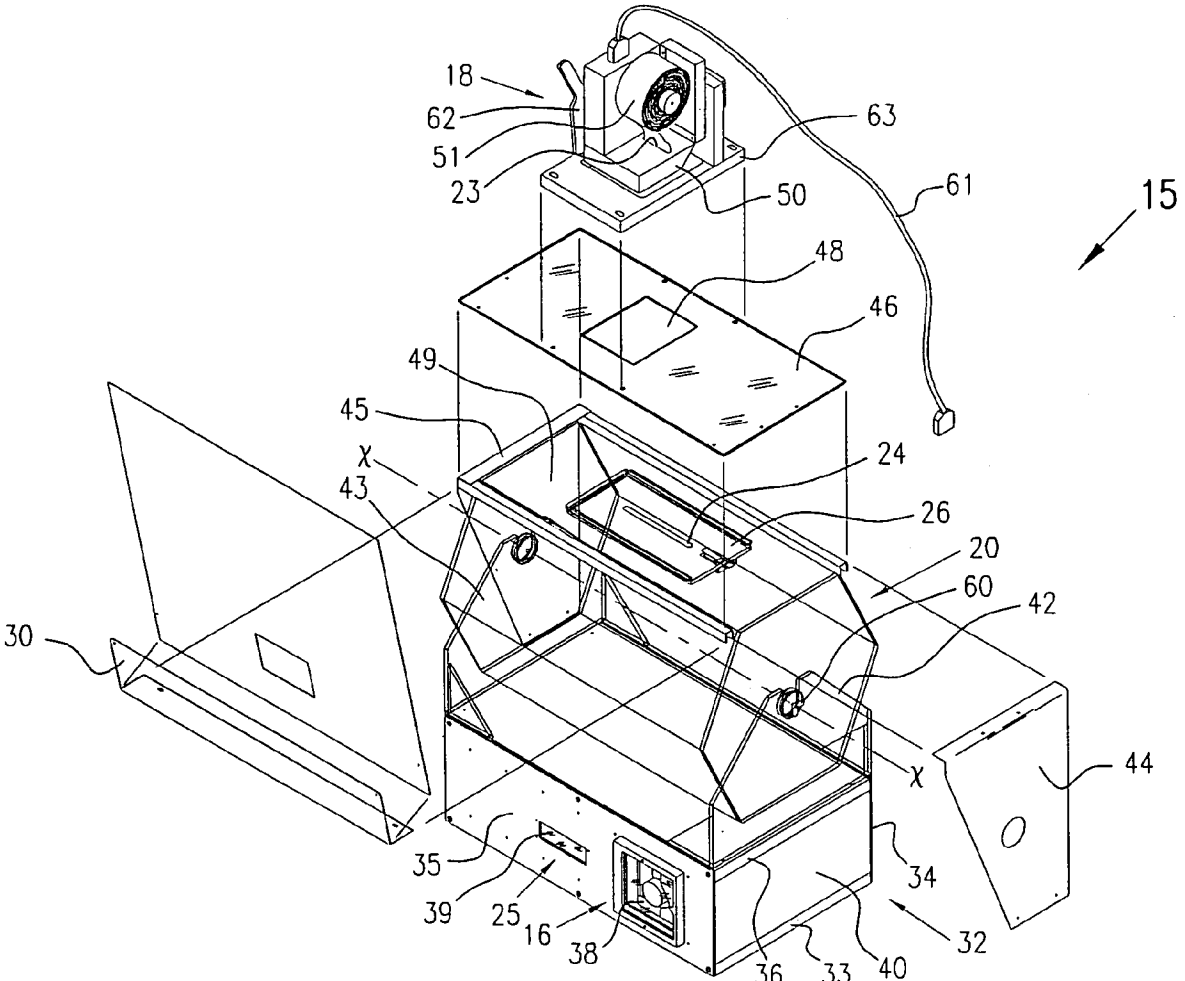
FIG. 2 is an exploded view of the raffle assembly shown in FIG. 1.
Figure 3:
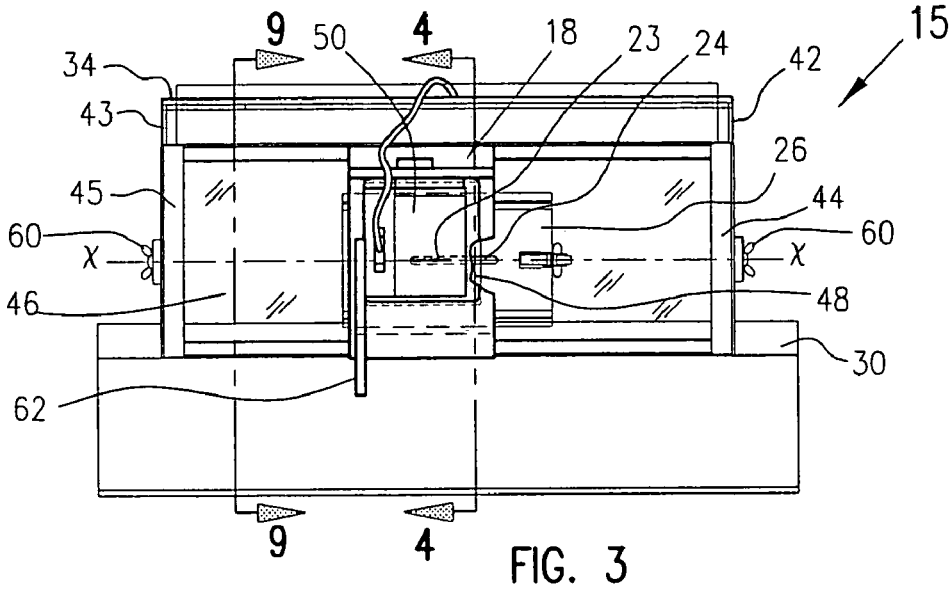
FIG. 3 is a top plan view of the raffle assembly shown in FIG. 1.
Figure 4:
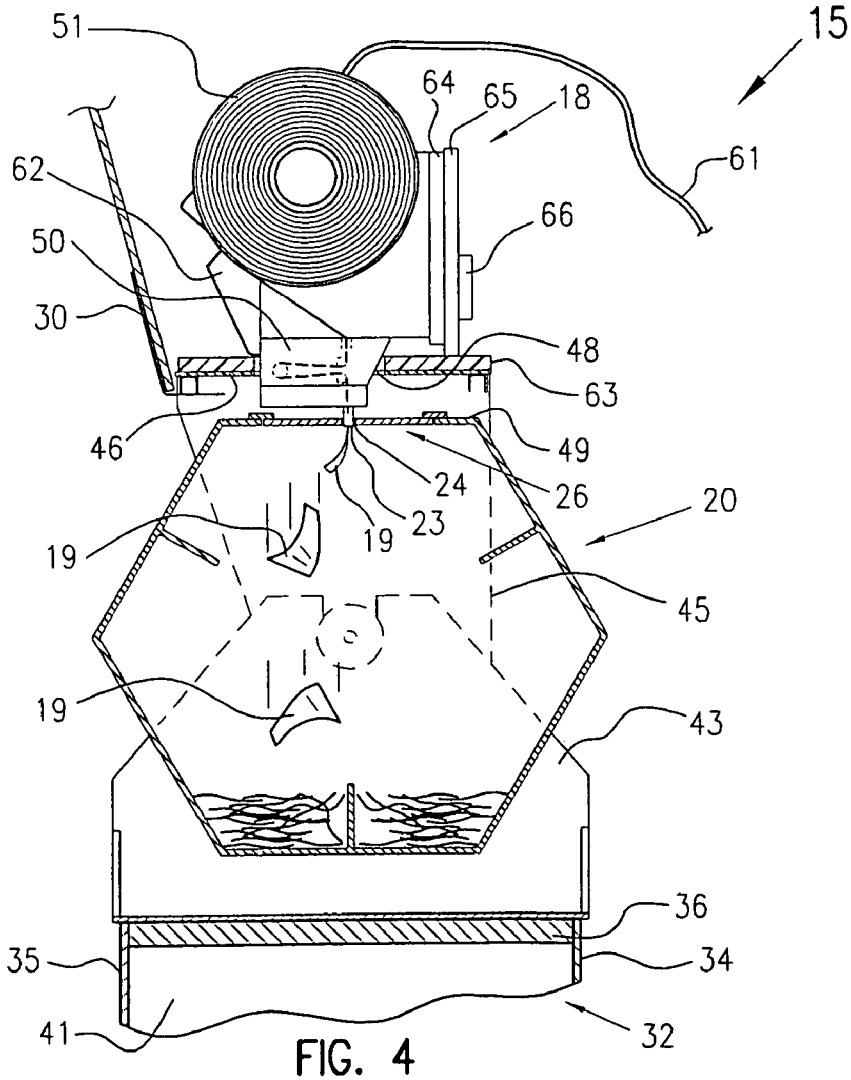
FIG. 4 is a partial vertical sectional view of the raffle assembly shown in FIG. 3, taken generally on line 4—4 of FIG. 3.

Referring now to FIGS. 1–2, this invention provides an improved raffle assembly, of which the presently preferred embodiment is generally indicated at 15. The assembly is shown as broadly including a bar code scanner 16, a data processor 22, a printer 18, a digital display 25 and a ticket guide.

Bar code scanner 16 is a conventional scanner which allows for the collection of information from a bar code. Each visitor to a trade show or customer to a retail outlet, for example, can be given an identifier card having a bar code containing that participants contact information. Scanner 16 allows for such information to be collected automatically by conventional processor 22. The model LS-5800 bar code scanner manufactured by Symbol Technologies, Inc., of One Symbol Plaza, Holtsville, N.Y. 11742-1300, may be employed in the preferred embodiment. It is contemplated that other scanners may be used, such as a magnetic code scanner that reads information from a magnetic strip on a card.

Processor 22 is a conventional processor that communicates with scanner 16 and with digital display 25. Mainboard 31 provides interface connections between processor 22, hard drive 17, scanner 16 and digital display 25, respectively. The Diamond Max Plus 8 ATA hard drive provided by Maxtor Corporation, of 500 McCarthy Boulevard, Milpitas, Calif. 95035, and the EPIA M Mainboard, with a VIA C3/EDEN EBGA processor, manufactured by VIA Technologies, Inc., of 940 Mission Court, Fremont Calif. 94539, may be employed in the preferred embodiment.

Digital display 25 communicates with processor 22 and displays the information scanned by scanner 16 so that such information can be reviewed and connected if necessary by the participant. The model TD3000 series digital display manufactured by Logic Controls, Inc. of 355 Denton Avenue, New Hyde Park, N.Y. 11040 may be employed in the preferred embodiment.

Processor 22 in turn communicates with printer 18 through printer cord 61. Some or all of the contact information collected from scanner 16 by processor 22 is printed on an individual raffle slip or ticket 19 by printer 18. Thus, printer 18 allows the exhibitor to print information about each visitor or customer on individual tickets of paper 19 that are configured to be drawn in a raffle and to provide the winner's name and contact information. The model TK/VL41 series printer manufactured by Fenix Group, of Barcelona, Spain, may be employed in the preferred embodiment.

Processor 22 may be programmed to perform other functions such as data storage and participant screening. For example, processor 22 may be connected to a central processor where information from one or multiple raffle assemblies may be collected or used for marketing purposes. In addition, processor 22 may be programmed to check to make certain that multiple raffle tickets for the same participant are not printed and deposited in collection bin 20. In this way, processor 22 may act as a gatekeeper to assure that only one raffle ticket is deposited per person, removing the ability of a single person to scan their information onto raffle tickets multiple times.

Figure 5:
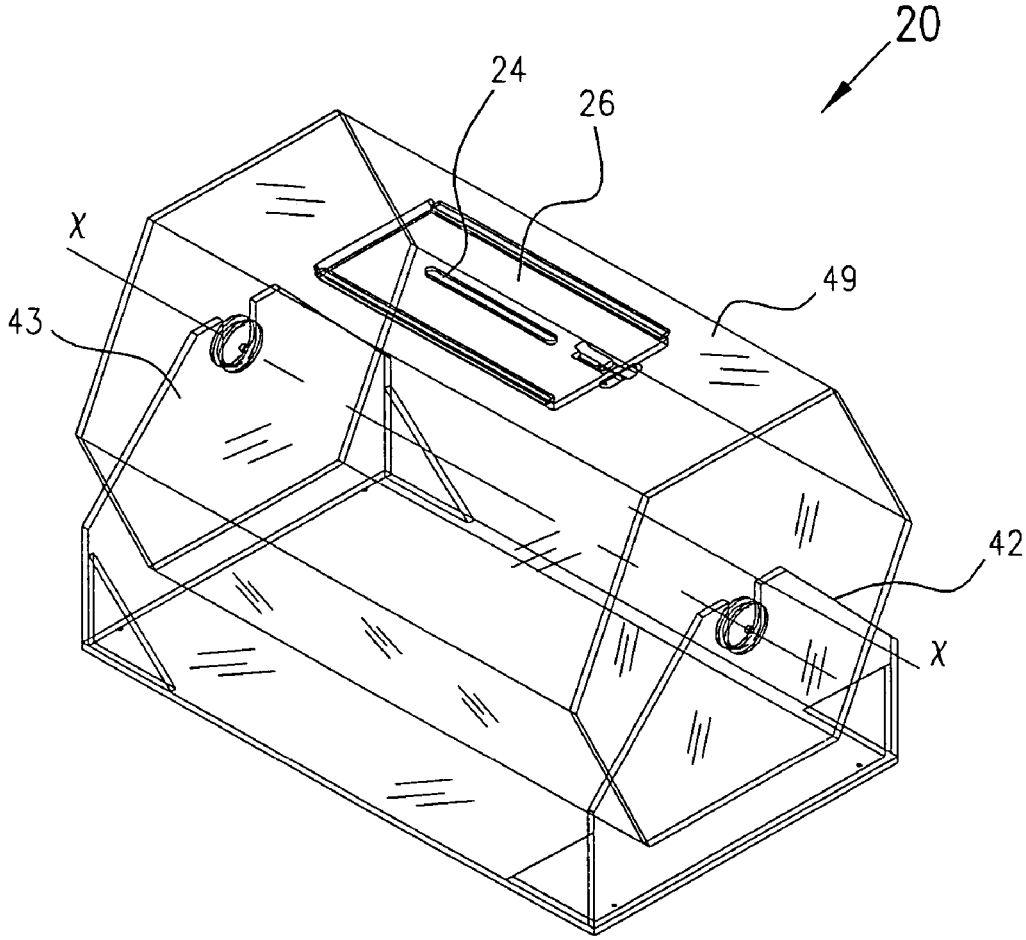
FIG. 5 is a perspective view of the collection bin shown in FIG. 1.

Printer 18 communicates with collection hopper or bin 20 so that each raffle ticket 19 printed by printer 18 is automatically directed into collection bin 20. As shown in FIG. 5, collection bin 20 is a hexagonal drum. Bin 20 is made of clear acrylic so that the interior volume where the raffle tickets are collected is viewable.

Figure 6:
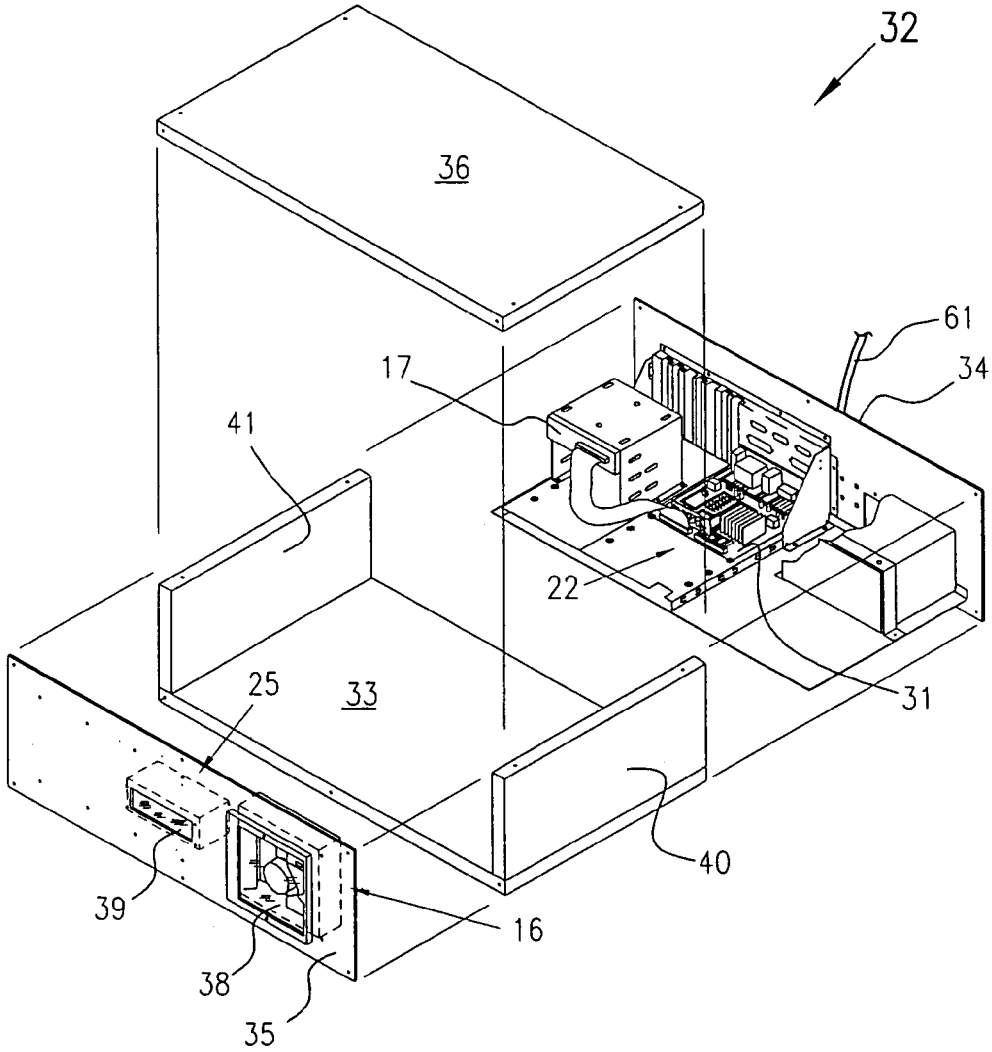
FIG. 6 is an exploded view of the base shown in FIG. 1.
Figure 7:
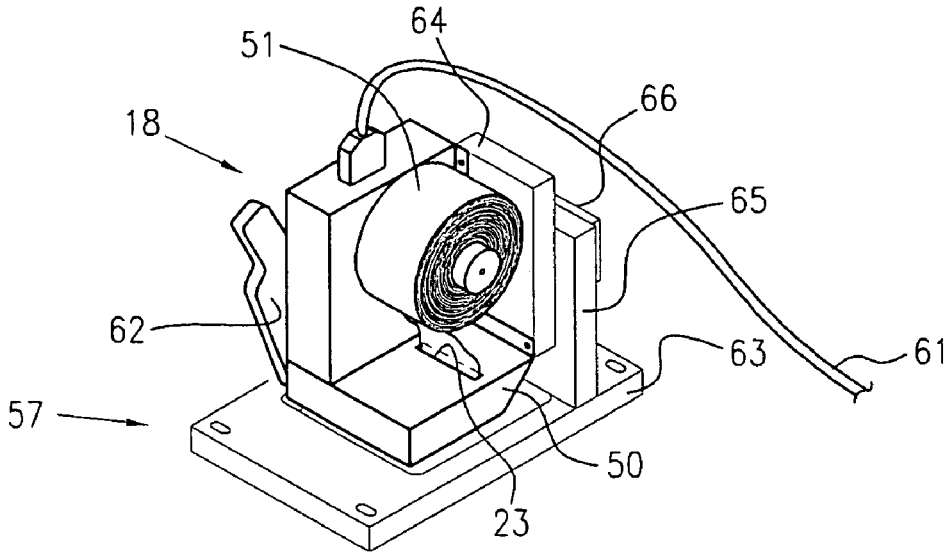
FIG. 7 is a perspective view of the printer and adjustment mechanism shown in FIG. 1.
Figure 8:
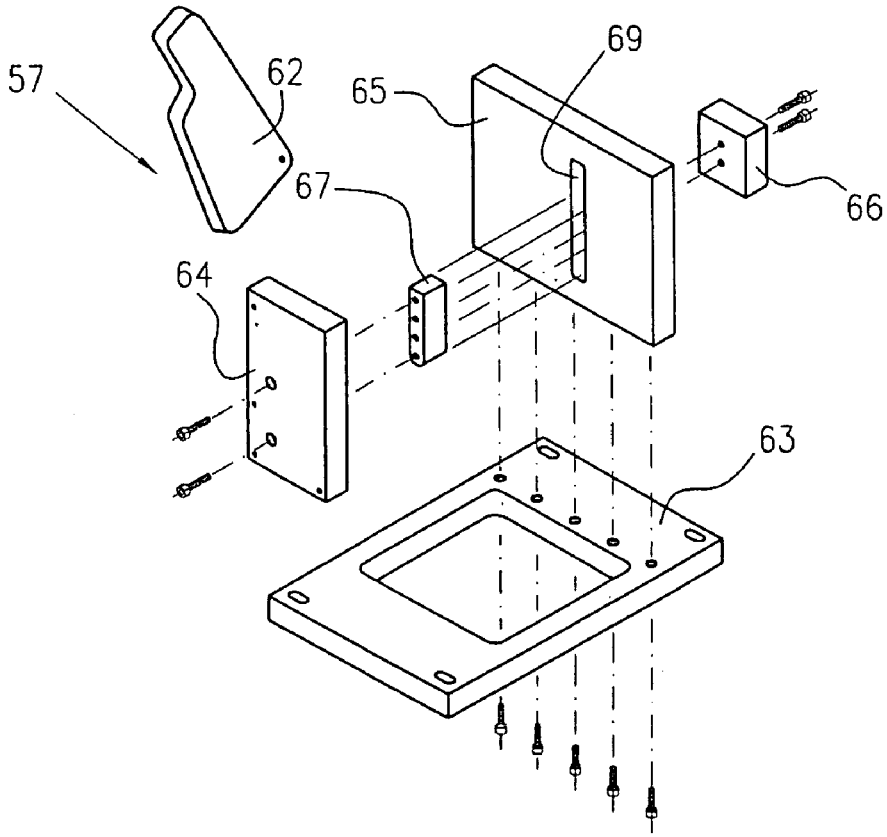
FIG. 8 is an exploded view of the adjustment mechanism shown in FIG. 7.

As shown in FIG. 6, scanner 16, processor 22, digital display 25 and motherboard 31 are housed in a base 32. Base housing 32 comprises a horizontal base plate 33, a vertical rear face plate 34, a vertical front face plate 35, a vertical side plate 40, a vertical side plate 41 and a top horizontal plate 36. Front face plate 35 includes a scanner face panel 38 through which scanner 16 can scan participant cards. Front plate face 35 also includes a display opening 39 through which a customer may view scanned information on digital display 25.

Bin 20 is removably supported by two vertical side supports 42 and 43 mounted to the top of base housing 32, as shown in FIG. 2. Bin 20 is supported on its axis x-x above base housing 32 by side supports 42 and 43 such that bin 20 may be detached from supports 42 and 43 and disengaged from the rest of the assembly. In addition, bin 32 may be rotated about axis x-x to allow access to the top panel 49 of bin 20.

Printer 18 is mounted to base plate 63 of printer shelf 46 above bin 20. Printer shelf 46 is supported at either end by vertical printer shelf risers 44 and 45, respectively. Printer shelf 46 and base plate 63 include a printer shelf opening 48 over which printer 18 is mounted.

As shown in FIGS. 4 and 7–10, printer 18 includes a horizontal printing element 50 which is suspended in opening 48 and may be adjusted vertically relative to opening 48. Member 50 has a rectangular printer discharge port 23 through which the end of the roll 51 of tickets extends. Collection bin 20 in turn includes an access door 26 in top panel 49, which in this embodiment is in a closed position during operation. Access door 26 contains a generally rectangular drop slot 24. Drop slot 24 has a width slightly greater than the outside width of port 23. Discharge port 23 and slot 24 are configured and aligned such that, when printer is in its lowered position, port 23 extends into slot 24. Not only does this allow for a seamless guide for ticket 19, but it also keeps bin 20 from rotating about axis x-x. Raffle ticket 19 output from printer 18 is thereby automatically directed through port 23 and slot 24 in access door 26 into collection bin 20.

Figure 9:
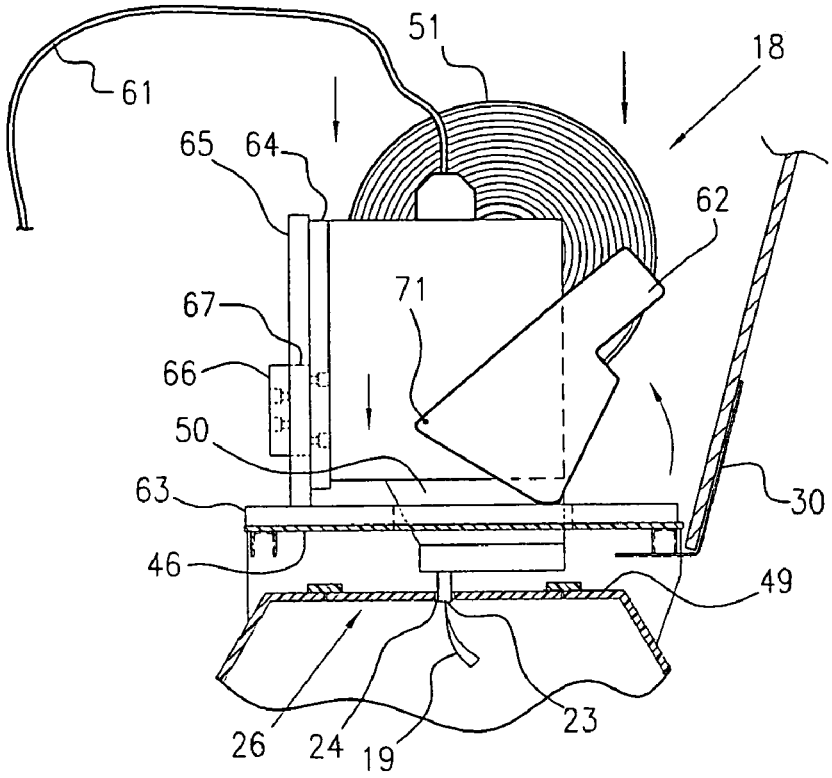
FIG. 9 is a partial vertical sectional view of the printer shown in FIG. 3 in its lowered position, taken generally on line 9—9 of FIG. 3.
Figure 10:
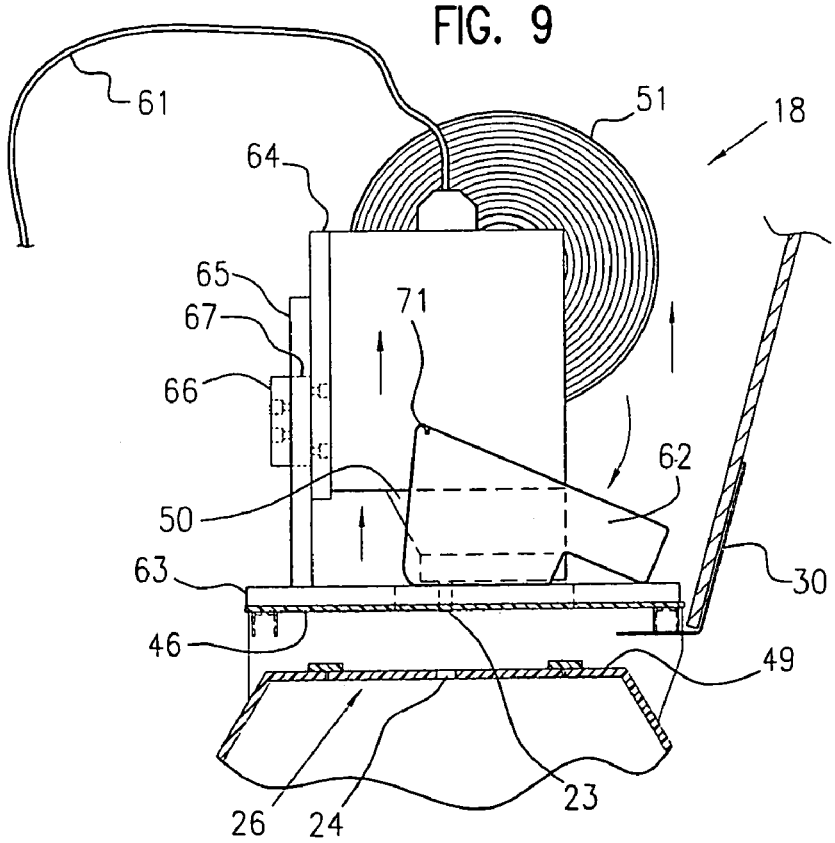
FIG. 10 is a partial vertical sectional view of the printer as shown in FIG. 9 but in a raised position.

As shown in FIGS. 9–10, printer 18 may be raised vertically with adjustment mechanism 57 to allow, as described below, rotation and removal of collection bin 20. In order for ticket 19 to be properly directed from discharge port 23 into drop slot 24, port 23 extends into slot 24 when printer 18 is lowered as shown in FIG. 9. This lowered position is desired during operation. Adjustment mechanism 57 is used to elevate printer 18 and withdrawal port 23 from slot 24 in order to thereby permit bin 20 to be rotated freely about axis x-x and removed from the assembly unencumbered by printer 18. In the preferred embodiment, printer 18 is elevated by moving adjustment arm 62 to the position shown in FIG. 10. The lever action of arm 62 against base plate 63 elevates printer 18.

As shown in FIGS. 7–10, adjustment mechanism 57 comprises adjustment arm 62, base plate 63, vertical printer plate 64, vertical guide plate 65, slide member 67 and retaining block 66. Vertical guide plate 65 is mounted to base plate 63 of printer shelf 46 and includes a vertically extending slit that defines a rectangular guide channel 69. Sliding member 67, which is sized to allow it to move vertically in guide channel 69, is fixably interposed between vertical printer plate 64 and retaining block 66. When arm 62 is in its raised position, shown in FIG. 9, printer 18 is in its lowered operational position, with the bottom surface of sliding member 67 resting against the bottom of guide channel 69 and thereby vertically supporting printer 18. Without a counterbalancing force against arm 62, the weight of printer 18 will keep printer 18 in its lowered position and hold arm 62 in its raised position.

Arm 62 is pivotally mounted at pivot 71 to printer 18 such that moving arm 62 to its lowered position, shown in FIG. 10, causes member 67 to slide up in guide channel 69 until member 67 reaches the top of guide channel 69, elevating printer 18. Thus, printer 18 can be elevated relative to printer shelf 46 and slot 24 a distance equal to the difference between the vertical thickness of slidable member 67 and the length of guide channel 69. This distance is large enough to allow port 23 to be fully withdrawn from slit 24 when printer 18 is so elevated.

With printer 18 in its raised position, collection bin 20 can be disengaged from the rest of the assembly 15 by loosening wing nuts 60, thereby allowing easy access through access door 26 for a drawing to select the winner of the subject raffle prize or prizes. Thus, assembly 15 allows for a visitor's card to be scanned, certain information coded on the card to be printed by printer 18 on ticket 19, and ticket 19 guided to collection bin 20 in a secure and automated manner through printer discharge port 23 and correspondingly aligned drop slot 24 for deposit into collection bin 20. Once in collection bin 20, a raffle ticket 19 may be drawn at a later time as a winning ticket for the raffle.

As shown in FIG. 1, assembly 15 includes an advertising support member 30 to which marketing material may be mounted. Support member 30 is mounted to the front edge of printer shelf 46.

Figure 11:
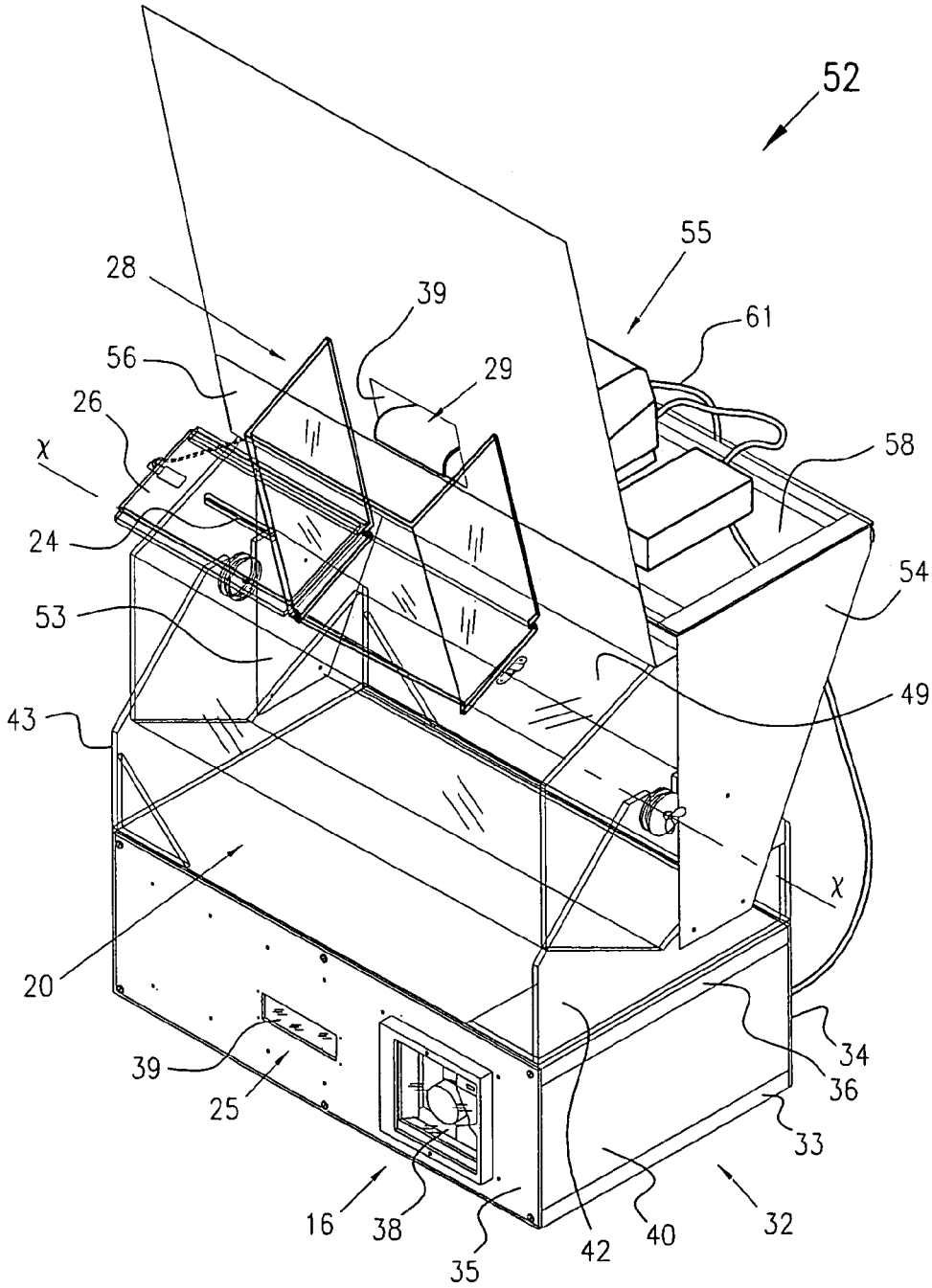
FIG. 11 is a perspective view of an alternate embodiment of the improved raffle assembly.
Figure 14:
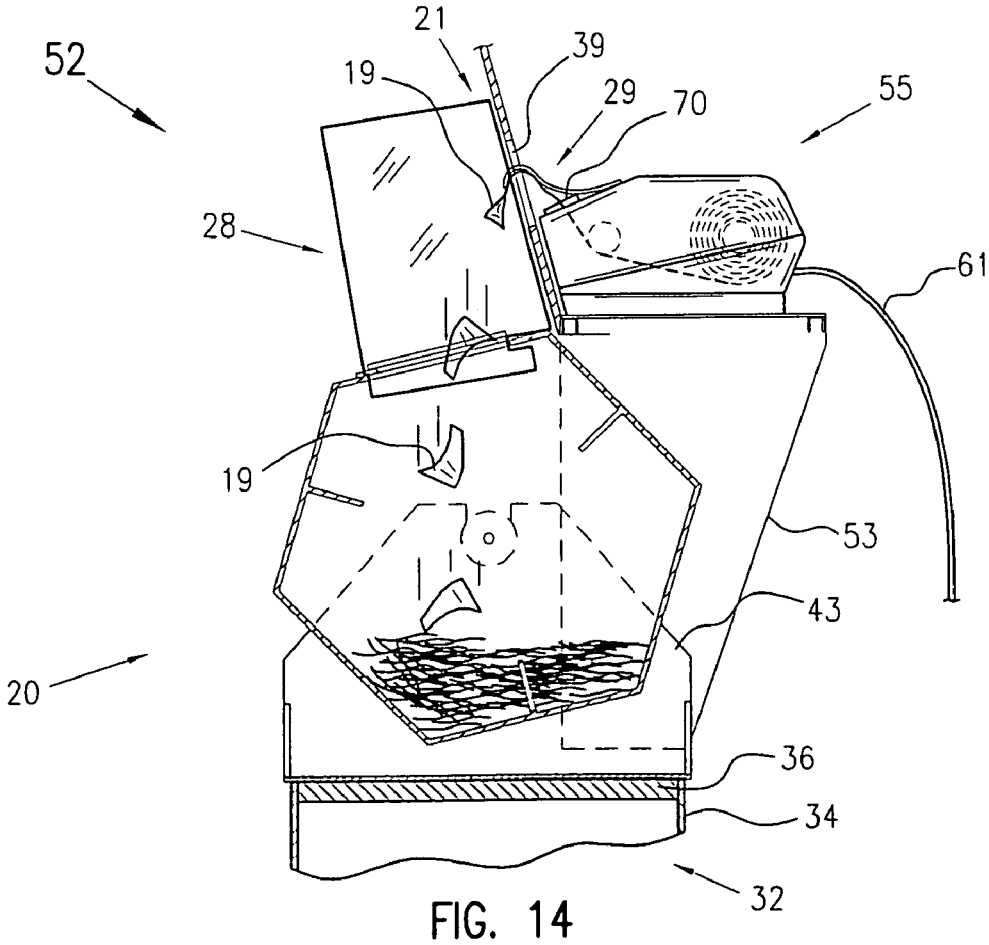
FIG. 14 is a partial vertical sectional view of the raffle assembly shown in FIG. 13, taken generally on line 14—14 of FIG. 13.
Figure 15:
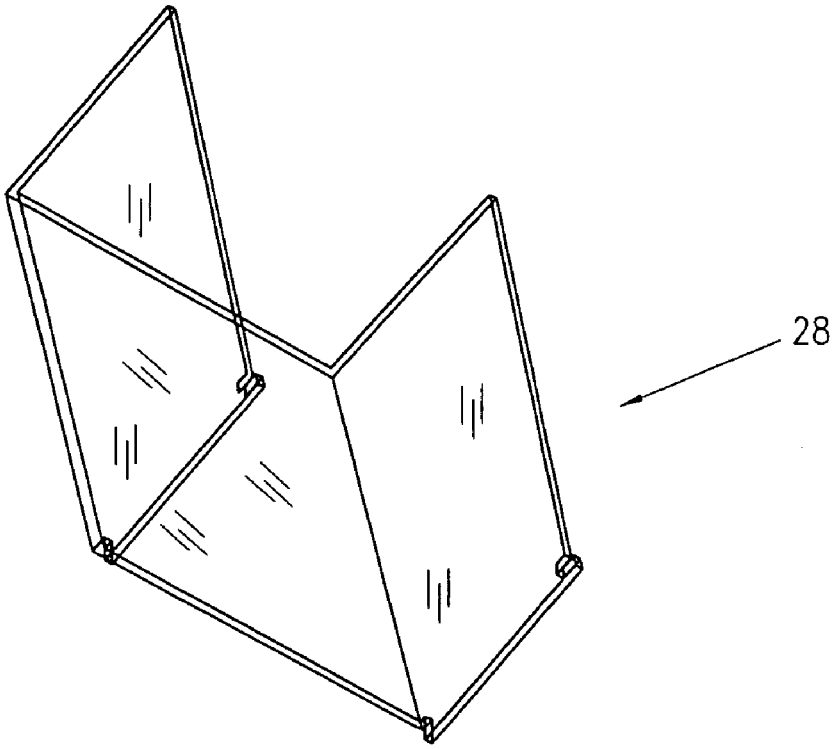
FIG. 15 is a perspective view of the ticket chute shown in FIG. 11.
Figure 16:
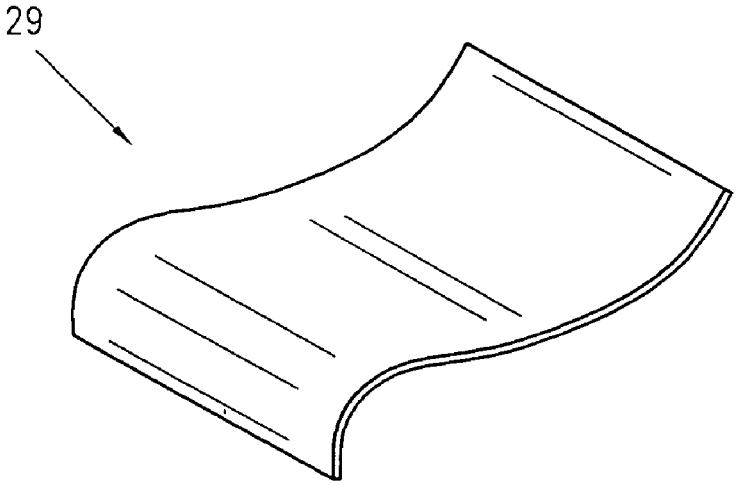
FIG. 16 is a perspective view of the printer ejector guide shown in FIG. 11.

FIGS. 11–16 show an alternate embodiment 52. In this embodiment, as shown in FIGS. 11–16, an alternate ticket guide 21 is employed. Printer shelf risers 53 and 54 are mounted to bin supports 42 and 43, respectively, to the real of the axis of rotation x-x of bin 20. Thus printer 18 is offset from access door 26 of bin 20. As shown in FIG. 11, ticket guide 21 includes a ticket chute 28 and a printer ejector guide 29. Printer 55 is different from printer 18, ejecting raffle ticket 19 from the top of the printer 55 rather than the bottom. A TSP700 Series printer manufactured by Star Micronics America, Inc., of 1150 King Georges Post Road, Edison, N.J. 08837-3729, may be employed in this alternate embodiment. Attached above the printer ejection port 70 of printer 55 is ticket ejector guide 29. As shown in FIG. 16, printer ejector guide 29 is an arcuate member. As ticket 19 is printed, ejector guide 29 directs it downwards into ticket chute 28.

Ticket chute 28 is mounted to the top panel 49 of bin 20. As shown in FIG. 15, ticket chute 28 is defined by a top surface, a rear surface, and two side surfaces. As shown in FIGS. 14 and 15, the front face of chute 28 faces printer 55 and is open. Similarly, the base of chute 28 is aligned over access door 26 of bin 20 and is also open. Thus, a ticket printed by printer 55 is directed into chute 28 by guide 29. The ticket then is funneled by chute 28 through open access door 26 and into bin 20.

Figure 12:
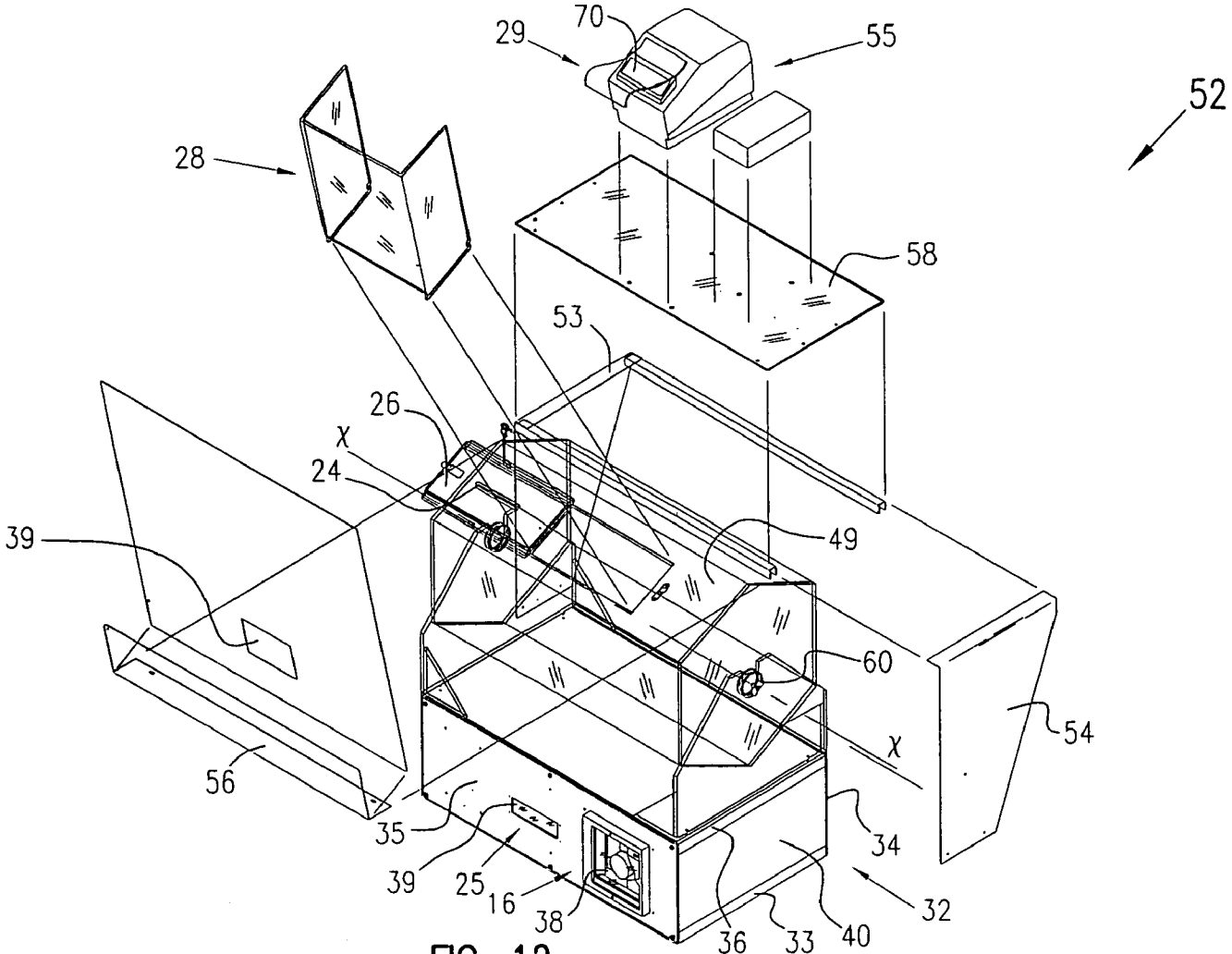
FIG. 12 is an exploded view of the raffle assembly shown in FIG. 11.
Figure 13:
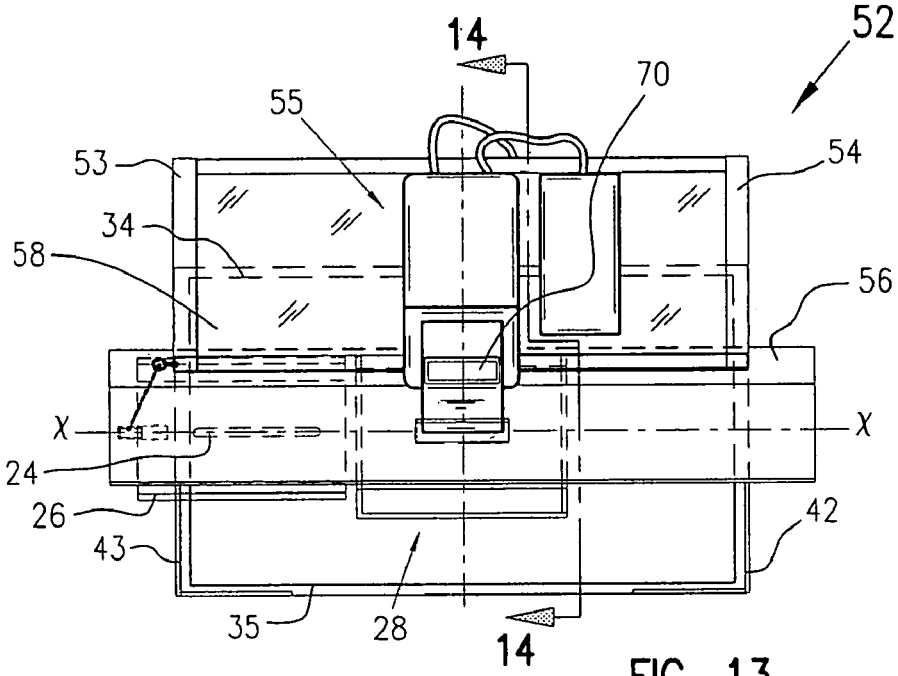
FIG. 13 is a top plan view of the raffle assembly shown in FIG. 11.

As shown in FIGS. 11 and 12, advertising support member 56 is mounted to the front of printer shelf 58. Because printer shelf 58 is offset to one side of access door 26 of bin 20, advertising support member 56 includes an opening 59 through which the end of guide 29 extends and through which ticket 19 is directed. As in the first embodiment, advertising support member 56 may be used to hold promotional material.

It is contemplated that the raffle assembly could be used in any venue where identification cards are used or available and an incentive is desired to encourage customers or potential customers to provide information or to otherwise create commercial interest. Such venues could include not only trade shows but grocery stores or other retail venues.

The present invention contemplates that many changes and modifications may be made. Therefore, while the presently preferred embodiment of the raffle assembly and an alternate embodiment have been shown and described, persons skilled in the art will readily appreciate that various additional changes and modifications may be made without departing from the spirit of the invention, as defined and differentiated by the following claims.

What is claimed is:

1. A fully automated raffle assembly comprising:

a data collection device adapted to read information;

a printer communicating with said data collection device and adapted to print multiple raffle tickets;

said printer and said data collection device so configured and arranged that said information read by said data collection device is communicated to said printer and printed on at least one of said tickets;

a collection bin;

said collection bin configured to hold said multiple raffle tickets commingled together for a drawing; and said printer and said collection bin so configured and arranged that said ticket is automatically fed into said collection bin after it is printed by said printer.

2. The raffle assembly set forth in claim 1, wherein said data collection device is selected from a group consisting of a bar code scanner and a magnetic code scanner.

3. The raffle assembly set forth in claim 1, and further comprising a ticket guide between said printer and said collection bin, said ticket guide configured to direct said ticket from said printer into said collection bin.

4. The raffle assembly set forth in claim 3, wherein said ticket guide comprises a printer discharge port and a collection bin opening, said discharge port aligned in said opening such that said ticket from the printer is fed through said opening into said collection bin.

5. The raffle assembly set forth in claim 4, and further comprising an adjustment mechanism between said printer and said collection bin, said adjustment mechanism adapted to selectively move said discharge port relative to said opening.

6. The raffle assembly set forth in claim 3, wherein collection bin comprises an access door and said ticket guide comprises a ticket chute between said printer and said access door.

7. The raffle assembly set forth in claim 6, wherein said ticket guide comprises an ejector guide between said printer and said ticket chute.

8. The raffle assembly set forth in claim 1, and further comprising a processor, wherein said data collection device and said printer communicate through said processor.

9. The raffle assembly set forth in claim 8, wherein said processor is programmed to store said information from said data collection device.

10. The raffle assembly set forth in claim 1, and further comprising a digital display communicating with said data collection device and adapted to display said information read by said data collection device.

11. The raffle assembly set forth in claim 10, and further comprising a processor, wherein said digital display and said data collection device communicate through said processor.

12. The raffle assembly set forth in claim 1, and further comprising an advertising support member.

13. The raffle assembly set forth in claim 1, wherein said printer is supported over said collection bin.

14. The raffle assembly set forth in claim 13, wherein said collection bin is supported over said data collection device.

* * * * *